US006766703B1

(12) United States Patent
Kluth et al.

(10) Patent No.: US 6,766,703 B1
(45) Date of Patent: Jul. 27, 2004

(54) APPARATUS AND METHOD FOR ENHANCING REMOTE SENSOR PERFORMANCE AND UTILITY

(75) Inventors: Erhard L. E. Kluth, Alresford (GB); Malcolm P. Varnham, Alresford (GB); John R. Clowes, Alresford (GB); Charles M. Crawley, Danville, CA (US); Roy Kutlik, Oakland, CA (US)

(73) Assignees: Sensor Dynamics Limited, Winchester (GB); Chevron U.S.A. Inc., San Ramon, CA (US)

( * ) Notice: Subject to any disclaimer, the term of this patent is extended or adjusted under 35 U.S.C. 154(b) by 34 days.

(21) Appl. No.: 09/668,049

(22) Filed: Sep. 21, 2000

Related U.S. Application Data

(63) Continuation of application No. PCT/US00/02748, filed on Feb. 2, 2000.

(30) Foreign Application Priority Data

Feb. 5, 1999 (GB) ..... 9902596

(51) Int. Cl.[7] ..... G01D 21/00

(52) U.S. Cl. ..... 73/866.5; 73/61.73; 73/152.28; 73/756

(58) Field of Search ..... 73/866.5, 756, 73/737, 61.73, 152.28, 737.06

(56) References Cited

U.S. PATENT DOCUMENTS

| | | | | |
|---|---|---|---|---|
| 3,961,185 A | | 6/1976 | Brokenshire et al. | 250/231.1 |
| 4,612,810 A | | 9/1986 | Martens | 73/705 |
| 5,371,720 A | | 12/1994 | Cuomo | 367/149 |
| 5,570,437 A | | 10/1996 | Kluth et al. | 385/12 |
| 5,582,064 A | | 12/1996 | Kluth | 73/4 R |
| 5,804,713 A | | 9/1998 | Kluth | 73/152.01 |
| 6,532,839 B1 | * | 3/2003 | Kluth et al. | 73/866.5 |

FOREIGN PATENT DOCUMENTS

| | | | |
|---|---|---|---|
| DE | 198 07 891 A1 | 8/1999 | G01L/11/02 |
| DE | 198 08 222 A1 | 9/1999 | G01L/11/02 |
| EP | 0 695 853 A2 | 7/1996 | E21B/47/06 |
| EP | 0 774 565 A3 | 10/1998 | E21B/47/00 |
| GB | 2 305 724 A | 4/1997 | G01L/27/00 |
| GB | 2 311 546 A | 10/1997 | E21B/23/08 |

* cited by examiner

*Primary Examiner*—Hung Xuan Dang
*Assistant Examiner*—Tuyen Tra
(74) *Attorney, Agent, or Firm*—Jaime A. Castano; Brigitte J. Echols; John J. Ryberg

(57) ABSTRACT

Apparatus and methods for sensing one or more physical parameters at a remote location while minimizing or eliminating contact between reservoir fluids and the like at the remote location and the sensor used to sense the physical parameters. In one example arrangement, the apparatus includes a tubing containing a communication cable and a sensor in communication with the cable, the sensor being located within the tubing proximate the remote location. The apparatus is configured to impose a barrier of a fluid between the sensor and the environment at the remote location. A fluid barrier reservoir containing the barrier fluid is also provided in some example arrangements.

35 Claims, 7 Drawing Sheets

APPARATUS AND METHOD FOR ENHANCING REMOTE SENSOR PERFORMANCE AND UTILITY

CROSS-REFERENCE TO RELATED APPLICATIONS

This application is a Continuation of International Application No. PCT/US00/02748, filed 2 Feb. 2000, which claims priority from United Kingdom Application No. GB9902596.7, filed 5 Feb. 1999.

FIELD OF THE INVENTION

The current invention pertains to remote sensing devices, and in particular to fibre optic sensors and communication cables used in such sensing devices, more particularly to methods and apparatus for protecting such sensors, communication cables, and conduits containing such sensors and communication cables from damage resulting from the ambient environment at the remote location.

BACKGROUND

Sensors for measuring pressure, temperature and temperature profiles, acoustic pressure waves and vibrations, magnetic fields, electric fields and chemical composition potentially can provide valuable information which can be used to characterise oil and gas reservoirs and for managing the cost effective and safe extraction of hydrocarbon reserves from oil and gas wells. Locating such sensors in appropriate positions inside oil and gas wells using conventional methods is difficult and expensive. It is common practice in the oil industry to use wirelines or slicklines to lower sensors into remote downhole positions. While this type of deployment yields valuable information, the procedures make use of expensive equipment and personnel and require that normal production be interrupted. Slickline and wireline procedures also only provide occasional information.

Alternately, it is possible to locate sensors downhole permanently, but the conventional methods for doing this make use of specialist cables which are permanently attached to the production string and complicated mechanical packages such as side-pocket mandrels. This method of installing permanent sensors is extremely expensive and high failure rates are common. When a failure does occur then it is not possible to rectify it without major and extremely costly intervention. In general this is seen as impractical. Repairs can then only be undertaken when a well has to be worked over for other compelling reasons. Even under such conditions rectification of the fault is expensive. It is common experience that conventional pressure sensors such as quartz gauges and silicon strain gauges fail after relatively short periods when at high well bore temperatures and pressures. For example at 135° C. or higher the expected lifetimes are short. Reasons for failures are often difficult or impossible to determine, but contributions to failure include failure of the transducer itself, or of downhole electronics, cable degradation and connector contamination.

These well known shortfalls in conventional sensors have led to the development of new types of sensors that can make use of optical fibre technology. The advantages that are invariably expected from this technology include the elimination of downhole electronics.

U.S. Pat. Nos. 5,570,437 and 5,582,064, assigned to Sensor Dynamics, Ltd. of Winchester, England, and which are incorporated herein by reference in their entirety, disclose methods and apparatus for deploying sensors into remote regions of oil wells which can provide permanent monitoring and yet allow cost effective correction in the event that sensors or their associated cables fail. These techniques make use of hydraulic control lines as a "highway" to deliver the sensors to the remote locations. The hydraulic control lines are rugged and provide effective protection for the sensors and their cables against damage during installation. To date the only sensors that have been able to make use of this form of deployment have been fibre optic sensors. They can be extremely small and flexible and can benefit from equally small and flexible cables. This allows such sensors to be moved along hydraulic small bore control lines by fluid drag and to be positioned in remote locations in oil and gas wells. Water is a most convenient fluid for deploying such optical fibre sensors in hydraulic control lines since it is readily available, has excellent low viscosity for pumping and can withstand conditions of very high temperature at high pressure. However, extensive laboratory testing by the assignee of the current invention has established that when optical fibre sensors or optical fibre cables are exposed to water at greater than 70° C. and simultaneously to high pressure, for example 2000 psi, then water causes damage to the sensors and also to the cables. It has been shown that water which is in direct contact with the silica fibres can enter into and react with the silica to create highly stressed layers inside the optical fibres. This can also cause failure of the silica through etching. In optical fibre pressure sensors, water ingress has been directly linked to rapid drift in the zero point of optical fiber pressure sensors. At 150° C. or greater, the zero point of unprotected fibre optic pressure sensors can change by more than 4000 psi over relatively short time periods. Similarly extreme behaviour has been shown to occur when unprotected optical fibre Bragg gratings are exposed to water under these conditions. Optical fibres have also been shown to change dramatically in length as a result of conditions within the wellbore. Changes greater than 1% have been measured.

In an effort to circumvent these undesirable effects, water has been replaced with a range of other fluids, including silicone or perfluorocarbon fluids and others, some of which are generally regarded as very inert and stable, even at temperatures above 200° C. Trials with these fluids showed that damage rates could be reduced but none of the fluids could eliminate damage entirely.

Similar trials with coated fibres showed some improvements, but in no case could a coating or combination of coatings be found which promised long-term survival of optical cables, or which reduced the zero point instability of optical fibre pressure sensors to acceptable levels. Significant improvements were found when optical fibres were coated with carbon, preferably followed by polyimide. However, even the most promising improvements were insufficient to yield a commercially attractive solution. A particular limitation that was identified appears to be associated with pinholes in coatings, which are very difficult to detect and which act as centres for chemical attack that can lead to spreading damage.

This has lead to a widespread search for other coatings that can be applied to the optical fibre sensors and to cables to prevent attack by water or other molecules. Extensive laboratory testing by the assignee of the current invention showed that a wide range of metal coatings failed to protect sensors or cables when exposed to water at high temperatures. Copper, gold and other metals were tried. None survived tests at 250° C. in water, over the long term. All coatings were found to affect the temperature sensitivity of the pressure sensor in an undesirable way, increasing the unwanted temperature sensitivity of a pressure sensor by greater than an order of magnitude. In every case additional complications were foreseen in protecting fusion splice joints that inevitably expose bare silica to the environment where optical fibres are spliced.

It has now been established that fibre optic sensors can be effectively protected to provide a stable response at high temperatures and pressures when the sensors are surrounded by silicone oil. This protection can be extended so that sensors can be deployed in remote locations, including downhole locations in oil and gas wells, where the well bore fluids can be highly corrosive.

A recent patent application by SensorDynamics, UK Application Number GB9827735.3, filed Dec. 17, 1998, teaches the use of liquid metals or other liquids in combination with a silica or elastomer capillary. Other materials may also be chosen for the capillary, for example sapphire. The use of metals or other materials that are in the liquid state under the expected operating conditions introduces a series of desirable features. Many Liquid metals readily "wet" and hence form a tight interface with silica; some liquid metals, indium, for example are reported to bond to silica. This also enables a highly reflective surface to be produced at a fibre cleaved end-face when "wetted" by a liquid metal or where the liquid metal bonds to the silica surface. Liquids cannot support shear stress and therefore do not cause sensors to change their behaviour with changing temperature. For example, polarimetric fibre optic pressure sensors do not become excessively sensitive to changes in temperature. Liquid metals also can readily protect splice regions as well as coated regions of optical fibres and mirrors. Liquid metals can be applied relatively easily to fibres and pumped into capillaries. The use of a liquid interface between the sensor surface and the surrounding capillary further permits the use of multiple coatings on the inside and outside surfaces of the capillary without introducing temperature sensitivity effects in the sensor. In principle the capillary can be used to add protection to cables as well as to sensors.

When pressure sensors are deployed inside hydraulic control lines, referred to as "sensor highways", it is necessary to ensure that the downhole well bore pressure can be communicated to the interior of the sensor highway where the sensors are located.

The interior of the sensor highway can be filled with a fluid. This fluid can be in the form of a liquid or gas. A useful liquid is an inert oil such as silicone based oil which can be comparatively stable at common bore hole temperatures and pressures. Silicone based fluids can be obtained commercially which are stable at 250° C. and higher. The stability of these fluids varies depending on their purity. It can be difficult to guarantee the purity of such fluids over extended periods unless the fluid is enclosed in a hermetically sealed environment. When the highway fluids are allowed to be in direct contact with well bore fluids, then diffusion and convection can occur. This can result in the ingress of water molecules and other species into the highway. In the long term this can result in a hostile environment that attacks even carefully packaged sensors.

It is therefore of great value to devise means for establishing and maintaining the fluid surrounding the sensors and cables in a condition which minimises change in sensors and cables.

SUMMARY OF THE INVENTION

The current invention discloses methods and apparatus for creating barriers and segments in a sensor highway utilizing fluids or mechanical devices for any and all of the following purposes:

1. Inhibiting or preventing the ingress of external or reservoir fluids into the highway (The Communication/Barrier Function);
2. Segmenting the highway to form separate sensing regions (The Segmentation Function).

Maximizing the long-term performance of sensors in the highway; and

3. Maximizing the long-term performance of sensors in the highway.

The invention includes apparatus and methods for sensing one or more physical parameters at a remote location while minimizing or eliminating contact between reservoir fluids and the like at the remote location and the sensor used to sense the physical parameters. In one embodiment the apparatus isolates the sensor within a tube containing the sensor. Specifically, apparatus includes a tubing containing a communication cable and a sensor in communication with the cable, the sensor being located within the tubing proximate the remote location. A sealing device is configured to seal a section of the tubing containing the sensor from fluid flow within the tubing, the sealing device being configured to be actuated between a sealing state and a non-sealing state. The apparatus further includes a communication device in fluid communication with the remote location and the section of tubing containing the sensor. A control line is in communication with the sealing device and is configured to actuate the sealing device between the sealing state and the non-sealing state. In a second embodiment, the apparatus is configured to impose a barrier of a fluid between the sensor and the environment at the remote location. Specifically, the latter apparatus includes a first tubing containing a communication cable and a sensor in communication with the cable, the sensor being located within the tubing proximate the remote location. The apparatus further includes a second tubing having a first end in fluid communication with the first tubing proximate the sensor. A fluid barrier reservoir containing a barrier fluid is also provided, the fluid barrier having a first opening in fluid communication with a second end of the second tubing, and a second opening in fluid communication with the remote location.

One method of the present invention includes a method for chemically isolating a sensor from a location at which a parameter is to be measured by the sensor, the location being in a fluid environment. The method includes emplacing within a tube a sensor in signal communication with a communication cable, the sensor being located within a section of the tube proximate the location at which the parameter is to be measured. The section of the tube containing the sensor is isolated from fluid flow within the tube, and the isolated section of the tube containing the sensor is exposed to the fluid environment at the location. The method can further include emplacing within a tube a plurality of sensors in signal communication with the communication cable, the sensors being located within selected sections of the tube proximate associated selected locations at which the parameter is to be measured. The tube selected sections of the tube containing the associated sensors are selectively isolated from fluid flow within the tube, and the isolated selected sections of the tube containing the associated sensors are exposed to the fluid environment at the associated locations.

Another method of the present invention for chemically isolating a sensor from a location at which a parameter is to be measured by the sensor includes emplacing within a tube a sensor in signal communication with a communication cable, the sensor being located within a section of the tube proximate the location at which the parameter is to be measured. A fluid reservoir is placed in fluid communication with the section of the tube containing the sensor, the fluid reservoir further being placed in fluid communication with the fluid environment. The tube is isolated to prevent passage of fluid out of the tube, and a first fluid is passed into the tube to cause the fluid to flow into the fluid reservoir. The method can further include measuring the volume of the first fluid passed down the tube and into the fluid reservoir, and ceasing flowing of the first fluid into the tube when a sufficient volume of the first fluid has been passed down the tube to fill at least a portion of the fluid reservoir.

DETAILED DESCRIPTION OF PREFERRED EMBODIMENTS OF THE INVENTION

Figure 1A:
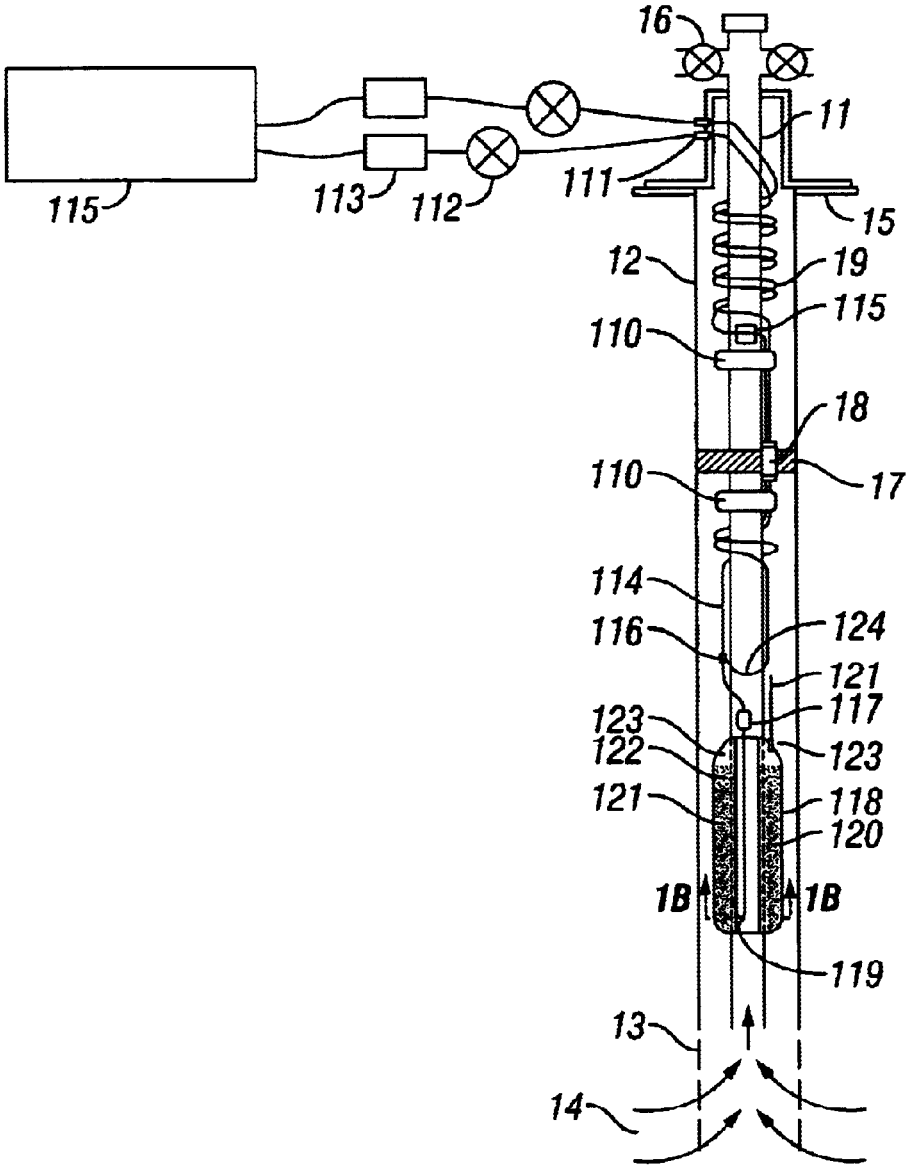
FIG. 1 depicts a schematic side elevation diagram of a wellbore containing a sensing apparatus in accordance with one embodiment of the present invention.

When acquiring downhole pressure information, pressure communication from the well bore to the sensor inside the highway should preferably be such that as little water or well bore fluid can enter the highway. It is important to minimise the possibility of foreign molecules entering the sensor and hence causing drift. Water molecules and OH groups are known to be chemically very aggressive at high temperatures and pressures and well bore fluids vary widely in composition, from well to well and in time. These fluids can be extremely aggressive chemically.

A prior art approach that reduces or eliminates the ingress of molecules from well bore into the region where the sensor is located is to interpose a membrane or diaphragm. This approach brings with it a number of disadvantages that can lead to difficulties in acquiring pressure information accurately. For example, the diaphragm or membrane have to respond to small changes in pressure, yet the direct contact with the well bore fluid can result in corrosion or in the scale formation which change the response of the membrane or diaphragm to pressure changes. It is also difficult to create a mechanical arrangement which can have the dynamic range required to cover the large pressure surges or which can resolve the minute pressure changes which can occur in oil and gas wells.

In accordance with a first embodiment of the present invention, an alternative approach to reduce or eliminate the ingress of molecules from well bore into the region where the sensor is located is to allow a direct connection between the well bore fluid and the interior of the sensor highway, in such a manner that the well bore fluid is prevented as much as possible from causing undesirable changes in the sensors or cables while allowing the relevant information to be acquired by the sensors.

In one example of the first embodiment of the present invention, the well bore pressure can be communicated accurately to the sensor through one or more intermediate liquids. The intermediate liquids are selected so that long-term exposure results in minimal change in the sensor. It is also preferable that the intermediate liquid can be easily replaced if contamination or degradation occurs in particularly hostile environments. Preferably this does not require the removal of the sensors and cables in the highway.

In another example of the first embodiment of the present invention, when the composition of the well bore fluid is to be analysed, the composition sensor probe is in direct contact with the well bore fluid. It is preferable that direct contact between well bore fluid and sensor probe is restricted to the time when the measurement takes place and that otherwise the sensor probe is in an environment that does not change or degrade the sensor or cable. For example, when a fibre optic fluorescence probe is used to ascertain aspects of the chemical composition of the well bore fluid, the end of the fibre optic probe should be directly immersed in the well bore fluid. If this direct contact is maintained permanently then it is likely that the optical fibre will suffer damage. On the other hand, the useful life of the probe is extended if direct contact is only occasional and if an inert fluid surrounds the probe at all other times. We describe two examples of how sensors and cables can be protected against damage when the sensors are used in oil wells. The examples are intended to be entirely non-limiting. One example treats the case of an over-pressure well, while the other treats the case of an under-pressure well.

An over-pressure well has a downhole pressure that is higher than the pressure exerted by a highway that is entirely filled with fluid. That is, if the highway were to be opened to atmospheric pressure at the wellhead, then fluid will be forced to flow upward in the highway. When the highway is sealed at the upper end of the highway, the fluid at the uppermost point will be at a positive pressure. This over-pressure condition applies typically to oil wells during their early stages of production when the hydrocarbon reservoir pressure is at its highest. If the fluid inside the highway is a liquid that has been carefully de-gassed, then this column of fluid has a high bulk modulus and therefore compresses very little under hydrostatic pressure. Under these conditions a surge in the downhole well pressure, which can occur when the flow rate of the well is decreased or shut off, will not cause significant amounts of well bore fluid to enter the highway.

In this case, pressure from the well bore can be communicated simply to the sensor inside of the highway by a length of tubing connecting the well bore to the highway. This tubing can be filled with (one or more) liquid metals or other fluids whose composition is such that it causes minimum change in the sensor over the long term. Alternately a combination of fluids may be chosen to form the barrier. The liquid metal or other fluid preferably should not mix readily or react chemically with the constituents of the well bore fluid. The function of this liquid metal or other liquid is to form a barrier to molecules from the well bore fluid and to prevent these from entering the highway and reaching the sensor.

The pressure communicating tubing which enables direct pressure communication between the hydrocarbon reservoir fluid and the highway fluid should preferably be arranged so that the well bore fluid contacts the liquid metal from above to prevent gas from rising from the well bore, through the liquid metal column or other fluid or series of fluids. This can be achieved by forming the connecting tubing into an elbow, with the well bore end of the column pointing upward.

The current invention thus includes methods and apparatus for creating barriers and segments in a sensor highway utilizing fluids or mechanical devices for any and all of the following purposes:

1. Inhibiting or preventing the ingress of external or reservoir fluids into the highway (The Communication/Barrier Function);
2. Segmenting the highway to form separate sensing regions (The Segmentation Function); and
3. Maximizing the long-term performance of sensors in the highway.

Figure 6:
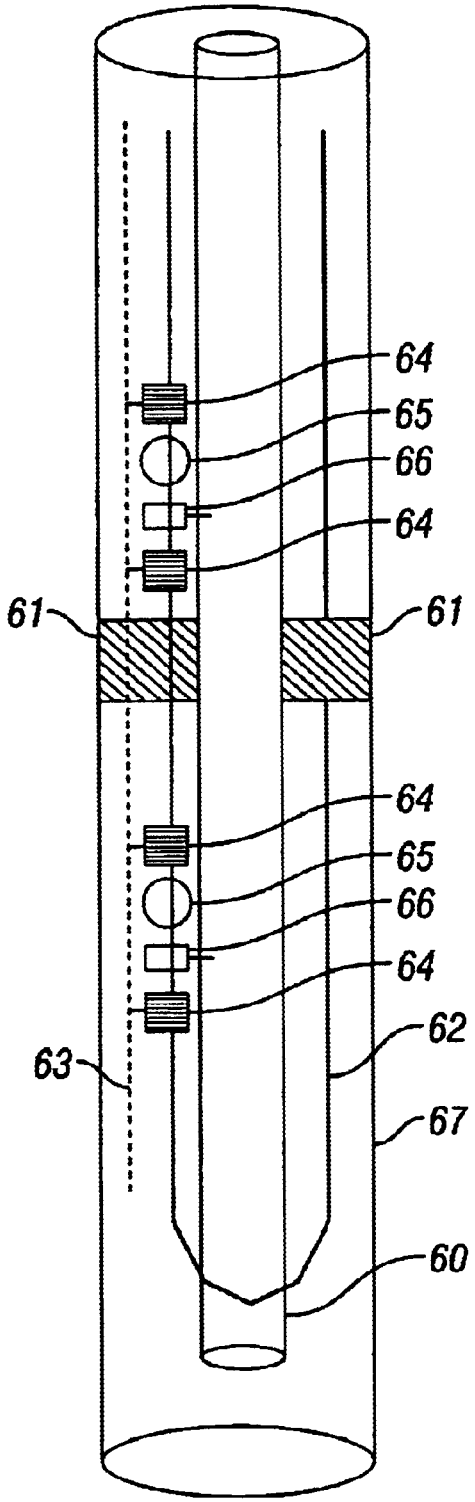
FIG. 6 depicts a schematic side elevation diagram of a wellbore containing a sensing apparatus in accordance with another embodiment of the present invention.

FIG. 6 illustrates schematically one example of how these objectives can be achieved, with specific reference to the measurement of pressure at more than one point in a sensor highway. A section of an oil or gas well is shown including a casing 67, a production string 60, a packer 61. The packer separates the annulus between the casing and the production string into two regions—one section above the packer and the other section below the packer. A sensor highway 62 and a separate hydraulic control line 63 are shown in the annulus between the casing and production tubing and both penetrate the packer. The sensor highway 62 is shown as a continuous control line that turns around at a point below the packer 61. Also shown in this diagram are two arrangements for measuring the pressure at a point above the packer 61 and at another point below the packer. Each arrangement includes sealing devices 64, pressure sensor 65 and pressure communication device 66. The pressure communication device 66 preferably includes a facility that allows it to be closed and opened from the surface. The pressure communication device 66 is connected into the well bore fluids inside the production string 60 and can preferably include a barrier function that prevents or minimizes ingress of well bore fluids into the highway region between the two sealing devices 64. The sealing devices are shown located above and below the sensor 65. Separate control line 63 can activate the sealing devices 64. It is preferable to create isolation zones that are as short as possible to minimize the volume of the zone, thereby minimizing any contamination that may pass through the barrier in device 66. A small volume is further advantageous because it maximizes the fidelity of the dynamic response of the sensor 65. Introducing sealing devices 64 further eliminates potential flow paths when multiple sensing zones are desired. For example, if the two sealing devices 64 that are shown between the two sensors 65 are removed, then a potential flow path is formed between the two pressure communication ports into the production string.

Figure 1B:
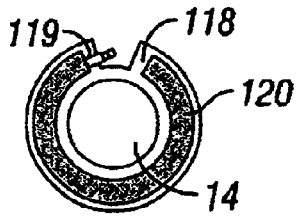

FIG. 1 shows a schematic view of an oil or gas well, fitted with a highway 100 for deploying and retrieving sensors and carrying out permanent downhole measurements, including the measurement of downhole pressure. FIG. 1 shows a production tubing string 11, surrounded by a casing string 12, a perforated section of the casing 13, to allow the inflow of hydrocarbon fluids 14 from the hydrocarbon reservoir into the well. The well is completed by a wellhead 15 that includes valves 16 for shutting the well in. A packer 17 is placed in the wellbore in the annular space formed between the casing 12 and the production tubing 11 to prevent the upper region of the annulus from being directly connected to the well bore pressure. The packer 17 is shown with a high-pressure penetrator 18 that allows the hydraulic control lines 19, which constitute part of the sensor highway 100, to pass through the packer. Typically the control lines are ¼ inch in diameter and are made of stainless steel. It can be convenient to coil the control lines around the production string at one or more regions along that string. The control lines can be secured to the production string by clamps 110, which also serve to protect the control lines from damage during installation. The sensor highway 100 is shown exiting the wellhead through high pressure seals 111, past valves 112 which serve as emergency pressure seal and then through high pressure feed-through devices 113 where the fibre optic cables emerge while maintaining a pressure seal between the ambient surface environment and the interior of the sensor highway. The sensor highway 100 comprises optical fibre cables and sensors. The sensors can include by way of example only pressure sensors, distributed temperature sensors, acoustic sensors, electric and magnetic field sensors, composition sensors and other types of sensors. The sensors or their associated cables need not necessarily be fibre optic types. The cable itself does not need to be connected to a sensor at all but can instead be used to communicate to an optical switch used to control downhole valves and machinery remotely. It is advantageous that the cables and sensors should be capable of being located to the remote locations by fluid flow, and thereby benefit from being retrievable and replaceable. In FIG. 1 the sensor highway 100 is shown to reverse directions at a point 124 below the packer 17. The return leg of the highway shown in FIG. 1 includes a flow control element 115 located above the packer for example only. This device 115 is configured to have two states, one of which can prevent flow of fluid in the upward direction or reduce flow to a reduced and acceptable rate. When the device is in the second state, fluid can flow freely in both directions. Preferably, a flow control element is used in both legs of the highway. Near the turn-around point 124, is shown a connection 116 to another section of control line that is shown to contain a flow control element 117 and which continues along the production string 11. Sensors that are deployed by used of the highway generally are prevented from entering the continuation of the control line beyond the turn-around region leading to the hydrocarbon reservoir. A distributed temperature sensor, such as can be used in conjunction with a distributed temperature sensing system, such as a DTS 80, available from York Sensors of Winchester, England, can be deployed in a single ended mode where the end of the sensor cable will be inside the highway 100, or in a double ended mode, where the sensor enters the highway in one leg and emerges at the surface from the other leg of the highway. Generally other sensors such as pressure, acoustic, electric field and composition sensors operate in reflection mode and hence enter the down-leg of the highway during deployment, but only emerge from the other end of the highway when they need to be retrieved from the highway. For example, a typical polarimetric pressure sensor, such as is available from SensorDynamic of Winchester, England, and its associated cable would enter the highway at the high pressure seal and the sensing part of the assembly would be located near the turn-around point of the highway, either in the down leg or in the up leg. The well bore pressure location 125 is communicated along the liquid pathway which starts at 121, connects to the barrier fluid reservoir 118 at connection 123 and passes through the barrier fluids 121 and 122 inside the reservoir 118, exits via connection 119 and continues through control line via connection 116 to the pressure transducer 114. In general it is preferable to have the end of the sensor and cable assembly pass the turn around point 124. This has the advantage that if fluid enters the highway from the hydrocarbon reservoir side of the highway, then the fluid flow will not cause the pressure sensor to change its position significantly. This will also be advantageous in the event that gas enters the highway. In this configuration, gas will be unable to enter the sensor capillary packaging and fluid barrier. Such a change in position could result in a change in the pressure reading.

It should be understood that although in FIG. 1 the highway 100 for deploying sensors is shown as a return control line, located in the annulus between the production string 11 and the casing 12, this should be regarded as one example only. The assignee of the current invention has demonstrated in field trials examples of highways which have been located both inside and outside the casing. In certain situations it can be preferable to locate the highway path inside the casing; in other situations it may be convenient or necessary to locate sensors outside the casing. For example, where acoustic information from the reservoir is assigned particularly high value, it is preferable to install the highway outside the casing. In another example, safety considerations can favour the location of the highway outside the casing in order to improve the isolation of the annular space above a packer from the zone below the packer. In yet another example, where it is necessary or desirable to monitor the state of an electric submersed pump, the highway is preferably located inside the casing. In yet other situations a mixture of both pathways may be preferred. For example, it is desirable to place the highway in the section above the packer outside the casing in order to have better acoustic coupling for reservoir imaging purposes while achieving a better isolation for safe operation, and yet to have the highway inside the casing for the purpose of monitoring the state of the perforated production interval. It should also be understood that the wall of the casing 100 can be used for creating a highway path for the sensors and their cables. Equally, the highway path can make use of the interior of the production string 11 or the wall of the production string for all or part of the highway circuit.

Modern drilling and completion techniques introduce other possible configurations for sensor highways to collect information from remote points in the hydrocarbon reservoir or near-by formations. As the techniques develop for real-time reservoir management, the need to have more direct information in locations inside the reservoir will increase. In another embodiment of the present invention, the sensor highway can make use of smallbore coiled tubing pathways or "lances" into the regions of the reservoir away from the production or injection wells. These coiled tubing lances can be used to collect a range of information including reservoir pressure, unaffected by the well bore effects, acoustic information, without high level interference from a producing well, composition information beyond the well producing zone and others. The flow control elements 115 and 117 that are shown in FIG. 1 are not necessarily required when dealing with oil wells whose downhole pressure exceeds the pressure exerted by a highway that is entirely filled with a fluid. In the over-pressure well example there is very little transfer of fluid from the hydrocarbon reservoir into the highway in the event of a pressure surge during a well shut-in. Hence the fluids 121 and 122 remain fully effective as a barrier between the highway fluid and the hydrocarbon reservoir fluid. In such over-pressure wells the use of the barrier fluid reservoir can also be eliminated or simplified. For example it can be replaced by a section of control line containing sufficient barrier fluid to compensate for expansion of the highway during a well shut-in.

As production of oil and gas proceeds over a period of time and the wells reach a state where the downhole pressure drops and becomes less than the pressure from liquid filled highway, control of fluid transfer to and from the highway via control elements 115 and 117 becomes important as does the barrier fluid reservoir 118.

During the well shut-in, if there is a decrease in the well bore pressure, as happens when the flow of the well is re-started, then fluid flow should be allowed to flow from the highway into the barrier fluid reservoir 118 so that the sensor measures the bore hole pressure and not the pressure exerted by the column of fluid in the highway, which will be higher than the bore hole pressure if fluid is not allowed to drain from the highway. This return flow rate is preferably high enough so that the pressure at the sensor remains representative of the instantaneous well bore pressure and is not dominated by the pressure caused by the weight of an unbalanced column of fluid in the highway above the sensor.

Figure 2:
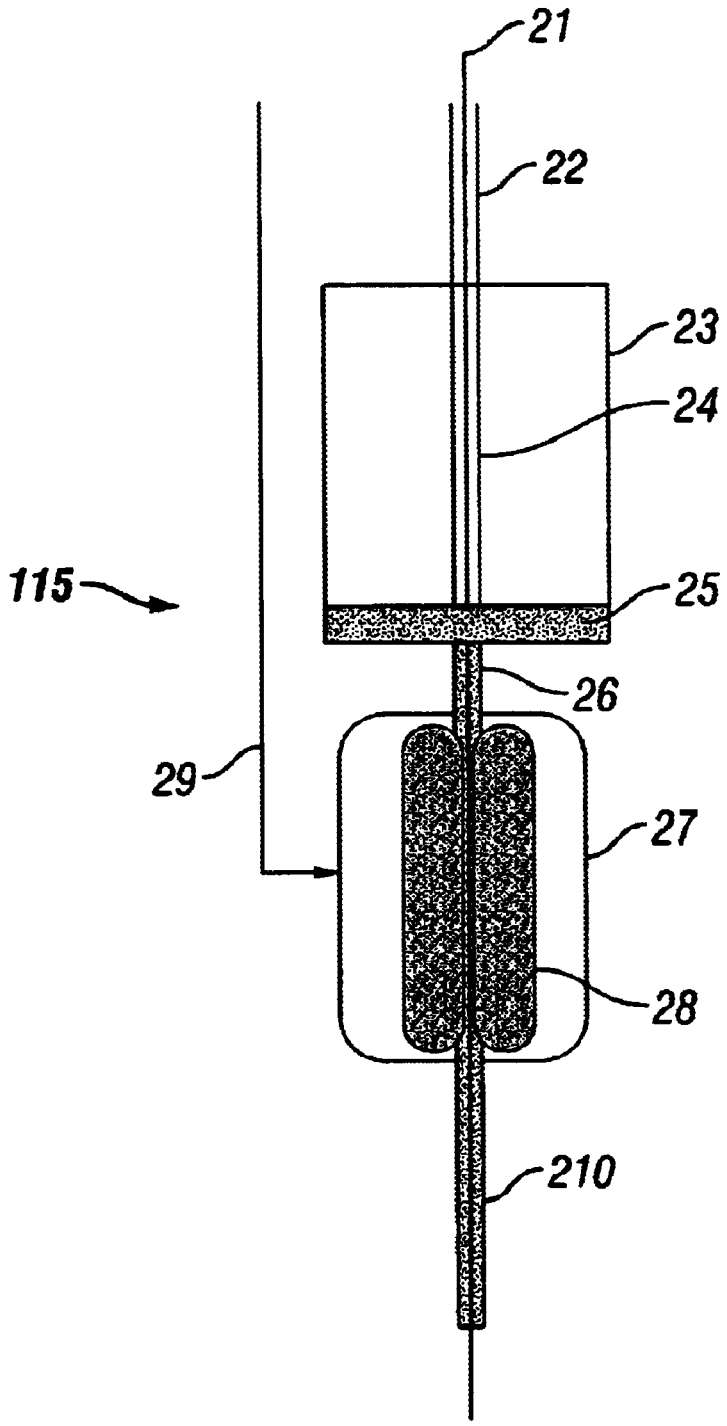
FIG. 2 depicts a schematic diagram of one example of a flow limiter which can be used in the sensing apparatus of FIG. 1.

A second example of the first embodiment of the present invention treats the case of the under-pressure well. As fluids are extracted from the hydrocarbon reservoir, the operating downhole pressure will decrease; the height of fluid column that is sustained in the highway will also drop. It is to be expected that the downhole pressure during normal production will reach a point where the highway fluid will drop to a level below the uppermost point in the highway, leaving a section of highway control line that does not contain liquid. In the event of a well being temporarily shut in, the resulting transient in downhole pressure will tend to push fluid into the highway until the weight of the column balances the downhole pressure. It is preferable to minimise the amount of fluid that has to be transferred into the highway to equalize the pressure during a well shut down. This minimises the required volume of the fluid reservoir between the highway and the well bore fluid. Minimising the flow will also minimise the error in the sensor reading due to pressure drops between the sensor and the well bore. In general it is desirable to have a fluid pathway between hydrocarbon reservoir and sensing location that has a low impedance to fluid flow. Hence, connections from point 125 into the barrier reservoir 118 and between 119 and the sensing location 114 are preferably as short as convenient and with a bore as large as is practical.

Where a number of sensor cables occupy space inside the highway, it can prove difficult to achieve a perfect seal around the multiple cables. Provided the flow rate through this seal is sufficiently low so that the height of the liquid column does not seriously degrade the measurement of the downhole pressure such leakage can be acceptable. In FIG. 2 we show by non-limiting example a configuration of the flow limiter (115 of FIG. 1) that preferably includes a reservoir in the space above the sealing or choking element to minimise the change in level inside the highway 100 during a negative pressure surge in the well bore due to imperfect sealing around the sensors or sensor cables inside the highway. That is, when the flow in the well is re-started following a period of shut-in, or when the well flow is simply increased, the pressure in the well bore will decrease and will eventually cause the level of liquid inside the highway to decrease.

Figure 7:
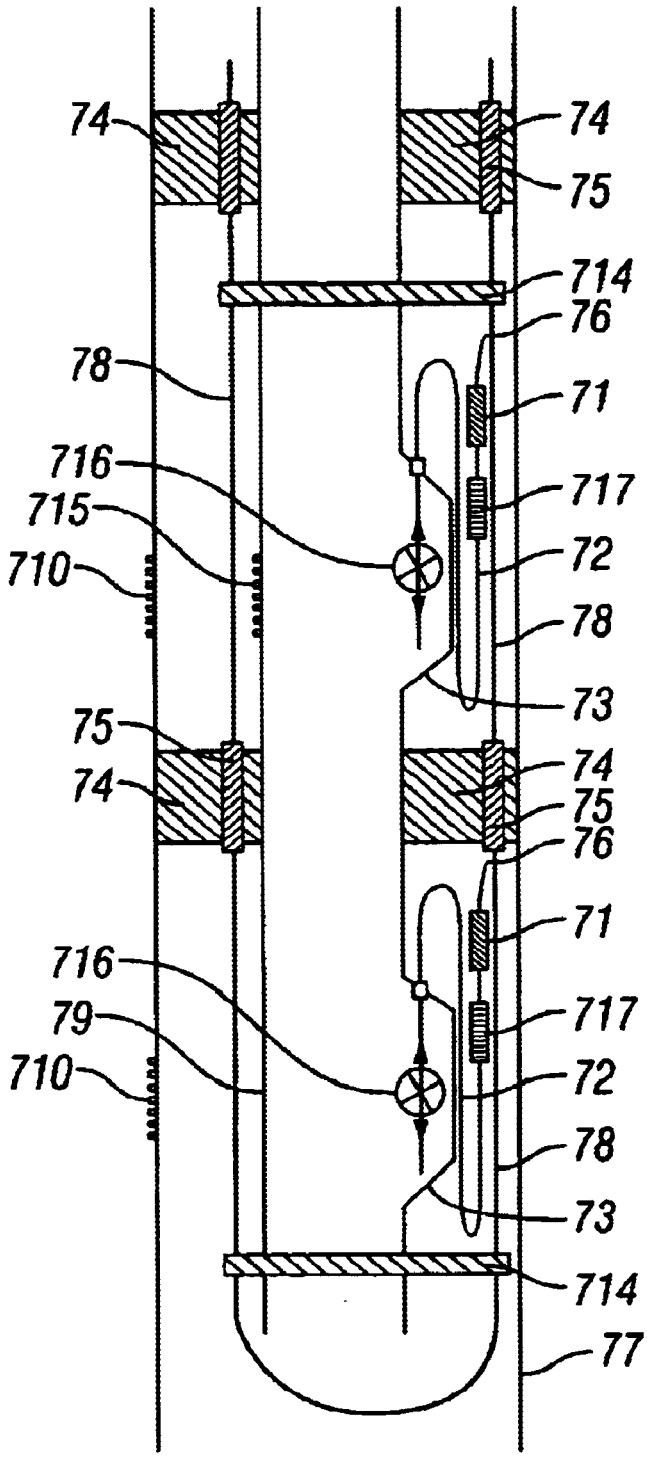
FIG. 7 depicts a detailed schematic diagram of a sensing apparatus within a wellbore in accordance with a third embodiment of the present invention.

In its simplest form control of the sensor highway in accordance with the present invention, and therefore control of the sensing environment, can be achieved using only fluids of different density and viscosity downhole. The main reasons for wanting to maintain control of the sensor highway are (1) maximizing sensor performance and minimizing measurement uncertainty, (2) to control and elimination of outside fluids into the highway system, (3) elimination of any potential internal highway flow paths, (4) to permit the "clearing" of any minor segments of the highway system that may be come contaminated by outside matter over time and restore full sensor measurement quality, and (5) to facilitate the replacement of individual sensors in the case of multiple sensors in the same highway. FIG. 7 shows a schematic view of an oil or gas well, fitted with a highway 700 for deploying and retrieving sensors and carrying out permanent downhole measurements, including the measurement of downhole pressure. FIG. 7 shows a production tubing string 79, surrounded by a casing string 77, and perforated section of the casing 710, to allow the inflow of reservoir fluids from the reservoir into the well. The well is completed by a wellhead (not shown) that includes master shut-in valves (also not shown) for shutting the well in. Packers 74 are installed to prevent the various regions of the annulus between the production tubing 79 and the casing 77 from being directly connected to the various reservoir zones. The packers 74 are shown with high-pressure penetrators 75 which allow the hydraulic control lines 78, which constitute part of the sensor highway 700, to pass through the packer. Typically the control lines are ¼ inch in diameter and are typically made of stainless steel. However, the actual control lines for any specific well must be designed to meet or exceed the metallurgical requirements of the well completion design. It can be convenient to coil the control lines around the production string at one or more regions along that string. The control lines can be secured to the production string by clamps 714, which also serve to protect the control lines from damage during installation. The sensor highway exits the wellhead through high pressure seals (not shown), past valves (also not shown) which serve as emergency pressure seals and then through high pressure feed-through devices (not shown), where the fibre optic cables emerge while maintaining a pressure seal between the ambient surface environment and the interior of the sensor highway system. The sensor highway system also includes "Y" branches 76, spur segments 72 to specific sensing locations, and connections to the inside of the production string 79 through the connecting port on the side pocket mandrel 73. The sensor highway system 700 contains optical fibre cables (not shown) and sensors (not shown). The sensors can include by way of example only pressure sensors, distributed temperature sensors, acoustic sensors, electric and magnetic field sensors composition sensors and other types of sensors. The sensors or their associated cables need not necessarily be fibre optic types. The cable itself does not necessarily connect to a sensor at all but instead can be used to communicate to an optical switch used to control downhole valves and machinery remotely. It is most advantageous that the cables and/or sensors should be capable of being moved to the remote locations by fluid flow, and therefore benefit from being retrievable and replaceable. It is further intended that the fluid segmentation and sensor isolation within the highway be accomplished by timed fluid pumping to place the different fluids precisely where they are desired. The location of the fluid sections that provide isolation or segmentation functions can be determined by monitoring the volume of the propelling fluid. This is accomplished by utilizing the surface highway control valves in conjunction with the downhole flow control valves 716 located in the side pocket mandrels 73. It can be beneficial (but not necessary) if the flow control valves in different mandrels 73 are configured to change state at different flow rates and differential pressures. The sensors or cables can be pumped into place to a position below where the gel plug 71 is intended to be set by manipulating flow rate in conjunction with the surface control valve (not shown) and the flow control valves 716 located in the side pocket mandrels 73. Commercially available gel forming materials can be used. Hydrophilic organic polymers such as hydratable polysaccharides and hydratable synthetic polymers, e.g., polyacrylamide, can be used to form aqueous gels. Numerous solid metallic crosslinking or complexing agents can be employed to complex the hydrated gelling agents. The metallic complexing agents can include antimony salts, aluminum salts, chromium salts, and certain organic titanates. The exact placement of the sensor in highway segment 72 is typically dependent on the type of sensor used. The fluid barriers 717 and the gel plug 71 can then be pumped into place by isolating the surface return line and controlling the flow path through either of the highway segments 72 via the flow control valves 716 located in the side pocket mandrels 73. Barrier fluids and gel plug design preferably take into consideration the nature of the contaminates and reservoir fluids expected and the maximum differential pressure that may have to be maintained between the segment and the main body of the highway. Further isolation and segment protection can be achieved by placing "fiber friendly" valves (i.e., valves that can form a non-damaging seal around one or more fibers inside the highway) in the highway spur segments 72 above where the gel plugs 71 is placed.

An operational example can include a polarimetric pressure sensor available from SensorDynamics of Winchester, England. The sensor and its attached fiber optic cable can enter the highway 700 at the high pressure seal at the wellhead. The sensing part of the assembly can be located below the location of the highway "Y" 76 and below the location where the gel plug 71 is set within the highway segment 72. The pressure is communicated to the sensor via a continuous fluid pathway that starts in the reservoir and enters the casing and production string and goes through the open downhole valve 716 in the side pocket mandrel 73 and connects to the barrier fluid in the highway segment 72 via the port 715. In the event that the performance of the sensor comes into question or if sensor or cable has failed, then the barrier plug 717 and the gel or segmenting plug 71 can be forced into the production string. The cable and sensor can then be pumped back to the surface and a replacement sensor and cable can be re-installed along with a new barrier fluid 717 and a gel or segmenting plug 71.

FIG. 2 describes a non-limiting example of the flow control element 115 of FIG. 1. It should be clear that such flow control elements can be installed in one or both legs of the highway and also that the precise location along the highway can include locations above the packer as well as below the packer. In FIG. 2, one or more fibre sensors or cables 21 are shown located inside the highway 22. The highway control line continues into a container 23. Inside this container the highway control line is shown to be perforated so that fluid can readily enter the main volume of the container 23, while encouraging sensors and their cables to be guided along the highway. Container 23 is shown to contain highway fluid 25 in the lower section of the container. Preferably this level is established by control from the surface, before flow from the well is reestablished. The purpose of the container is to reduce the change in fluid level in the highway for a given flow rate past the sealing or choking element and thereby minimise errors in the pressure measured at the sensing point. While the level of fluid is inside the volume 25, a small leakage past the seal or choke causes a much-reduced change in the column pressure.

It should be noted that the pressure at the sensing point in the well bore is at its highest when the well is stopped. At this stage the highway fluid can be forced down to a level that is near the bottom of container 23 by using, for example pressurised nitrogen gas at the surface. The seal or choke is then closed and the nitrogen gas pressure is released. The use of the term choke in this context is meant to indicate a significant reduction in flow past the device. The column of liquid in the highway will then be under positive pressure from the well bore. That is, if the choke element were to be opened, the well bore pressure would cause liquid to flow in the upward direction and reach a level above the choking element before the pressure exerted by the fluid column balances the well bore pressure. For the purposes of monitoring the dynamics of the well bore pressure accurately it is preferable to have the choke element closed and where a fluid reservoir 23 is included, to have this reservoir at least partially filled with highway fluid. The sensor reads the well bore pressure under these conditions. As flow is re-started in the well, the pressure in the well bore will drop, but it will remain greater than the pressure from the fluid in the highway provided the seal or choke is positioned low enough in the highway. The highway control line 26 is shown to connect to the sealing or choking device 27 that contains a remotely controllable seal or choke 28 and to continue as section 210. Line 29 indicates remote control of the choke. Different methods can be used to effect control. One method is to have an independent hydraulic control line leading from the wellhead to sealing or choking device 27. Other methods can be used, as for example when the cost of the independent control line is excessive. One such other method is to have a feed-forward connection from a point above the seal or choke to the control input 29. In this way the seal or choke can be set from the surface without an independent control line.

The arrangement shown in FIG. 2 serves to minimise or reduce the amount of fluid which flows up the highway in the event of a positive pressure transient in the well bore and also to eliminate or reduce to an acceptable value the errors which can arise at the sensor in the event of a negative pressure surge in the well bore.

An alternative approach to the flow control device in FIG. 2 is to eliminate the reservoir 24, but to retain the sealing device 27 and to make use of the barrier fluid reservoir 118 in FIG. 1. During normal operations the sealing or choking elements are set closed. In the event of the well being shut in, the well bore pressure will increase. The sealing device 27 will prevent movement of fluid into the highway. After the positive pressure transient information has been acquired, the fluid in one leg of the highway can be expelled to the surface by application of over pressure nitrogen or another gas to one of the legs of the highway while opening the other entry point at the surface. The surface entry points are closed. The liquid will then settle to the lower sections of the two highway legs. At this time the seals or chokes 27 can be closed. An alternative method that can be used to displace the deployment fluid inside the highway is to use another liquid that has the property that it changes to the gas phase at the well bore temperature. Under these conditions barrier fluid will be sucked upward into the highway if the highway is opened to ambient pressure at the wellhead. This method is preferred where it is desirable to surround the sensor and sensor cable by barrier fluid, in order to minimise degradation of sensors and cables in high temperature regions. The gas in the region above the barrier fluid is preferably chosen to be an inert gas such as nitrogen, for example. The gas in the highway above the seals is then allowed to come to ambient atmospheric pressure temporarily to allow the gas pressure to equilibrate approximately. At this stage the well bore pressure is at its highest and will be greater than the pressure exerted by the fluid column in the highway. The well flow can now be re-started and will cause the well bore pressure to decrease. The downhole sensor at position 114 in FIG. 1 will accurately record this decrease. As long as the well bore pressure exceeds the pressure exerted by the weight of the liquid column in the highway. This condition is assured by suitable choice of level for the flow control devices 115 in FIG. 1 or device 27 in FIG. 2. However, for a low pressure well or a heavily depleted well where the pressure has fallen to a low level of say 1000 psi, the choice of level for the flow control device can actually be very deep into the oil well close to production. For example, the maximum height h, of fluid of density $\rho$, between the choke and point of well production (32 in FIG. 1), allowed so that the well pressure is greater than that due to the column of fluid (equal to $\rho g h$, where g is the gravitational constant) can actually be quite small (of the order of a few hundred meters). Furthermore, this level will depend very much on the density of the chosen highway fluid that could be significant if a liquid metal is used. The deep positioning of the flow device will affect the operational specifications significantly as the temperature and pressure (in the early days of the well production) can both be extreme (temperatures up to 350° C. in some steam flood wells). A deeply positioned flow device will also require a deep reaching additional hydraulic control line if this were to be the chosen method of flow device control. Note, however that if these extreme conditions do not prove to be a problem, then the positioning of the flow devices as close as possible to (but still above) the sensor regions of the fibre can be of benefit. This makes it possible to operate with the majority of the highway empty, or flushed with dry nitrogen gas, and minimize the region of highway that has to be filled with inert, low water content fluid (for example a silicone oil or a liquid metal). The majority of the down lead cable can be exposed to high temperatures but in dry nitrogen gas, an environment that has little impact on the cable. This design reduces the required volumes of barrier fluid in the highway.

Because oil and gas wells have to function over long periods, it is also desirable that such devices are equally long-lived, or that they can be retrieved and replaced simply, without demanding the shutdown of normal well production. Deployable valves which are capable of sealing around fibre cables and which can be pumped along the highway and seated in appropriate locations, as taught by U.S. Pat. No. 6,006,828, which is incorporated herein by reference in its entirety.

It should also be evident that an independent pressure sensor can be placed into the highway to sense the position of the liquid in the highway. Preferably this pressure sensor is as far from the position 114 that is chosen to monitor the well bore pressure. The optimum point for this is immediately below the lowest equilibrium liquid level that can be expected during the life of the hydrocarbon reservoir. In an under-pressure well, this sensor will register the pressure due to the column of liquid above it. This information can be used to model the effect of fluid flow in the highway and to improve the data acquired by the primary pressure sensor which is located near the well bore at position 114 in FIG. 1.

The device 117 which controls the flow of fluid between the barrier fluid reservoir and the sensor highway control lines 19 in FIG. 1 preferably include the following features: While the sensors are being deployed, the fluid flow from the highway into the barrier fluid reservoir is kept to a low rate so that the flow in both legs of the highway is sufficient to move the sensors and cables. One solution which is given as a non-limiting example only, is to have a valve which allows downward flow from the highway up to a critical flow rate, at which time the valve closes to reduce or stop flow. This can be achieved by over-pressure from the surface at the start of any deployment operation.

When the flowing well is shut in and the well pressure rises, the impedance for fluid transfer from the barrier fluid reservoir into the highway is preferably low in the region between the barrier fluid reservoir and the position of the pressure sensor, so that the pressure at the sensor is representative of the well bore pressure and does not become dominated by pressure drops between the pressure communicating point 121 and the sensor location 114. Choosing as large a bore for the fluid path as is practical reduces the impedance. Preferably, the flow control unit 117 is capable of replacement if it becomes sticky or damaged. One method for performing this is disclosed in U.S. Pat. No. 6,006,828, which is incorporated herein by reference in its entirety.

Figure 3:
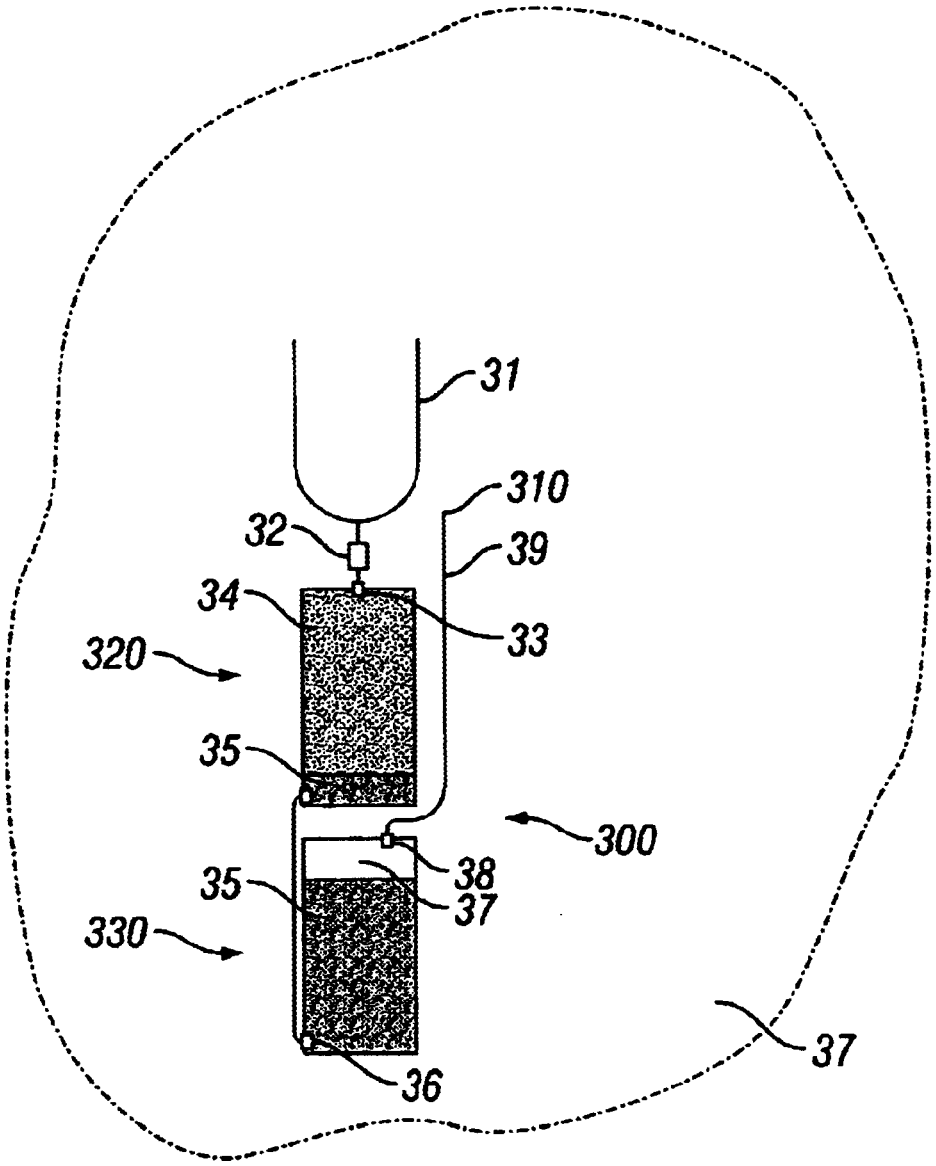
FIG. 3 depicts a schematic diagram of a first barrier fluid assembly which can be used in the sensing apparatus of the present invention.

With reference to FIG. 3, one non-limiting example of a barrier fluid assembly 300 is shown. The highway that contains the pressure sensor 31 (and possibly other sensors) connects to a first barrier fluid reservoir section 320 at connection 33. This reservoir is shown to contain a first barrier fluid 34 and a second barrier fluid 35. The connection can contain a flow control device 32. The first barrier fluid reservoir section 320 connects to a second barrier fluid reservoir section 330 at connector 38. The second barrier fluid reservoir contains the second barrier fluid 35 and can also contain fluid 37 that is the same hydrocarbon fluid as the well bore fluid 37. Barrier fluid 34 is of a lower density than barrier fluid 35 and the two fluids are preferably highly non-miscible. Fluid 35 can be chosen to be a fluid such as an indium based alloy which is in the liquid state at the well bore temperature and which has a low propensity to react chemically with the hydrocarbon well bore fluids. Preferably fluid 35 also minimises the diffusion of molecular species of the well bore fluid. It should be recognised that a single barrier fluid can be sufficient in wells where the well bore fluid is sufficiently benign chemically. Equally it is possible to realise a design that includes a single reservoir container, even if two barrier fluids or more are used, provided that the relative densities are such that the ordering of fluids according to the densities achieves the objectives.

It is also to be noted that if either barrier fluid 34 or fluid 35 become contaminated or degraded, then it is possible to displace these into the well bore and replace the fluids with new fluids without requiring the well to be shut in. This can be achieved for example, by injecting fluids 34 or 35 at the wellhead through the hydraulic control line. If the ambient well surface temperature is below the melting points of either fluids, then these materials can be injected in the form of small pellets. These pellets will change to liquid at a depth where the well temperature exceeds the melting point of the pellet material.

Barrier fluid 34 is preferably a liquid metal such as gallium or other metal which is in the liquid state at the well bore temperature, which is of lower density than fluid 35 and which does not tend to mix with fluid 35. This fluid 34 can also be a non-metallic fluid that is inert with respect to fluid 35 and with respect to the pressure sensor or its package. The first barrier fluid 34 is also preferably chosen to have a low viscosity so that it can flow with low resistance within the highway control line 31 and thereby minimise errors in the measurements by the pressure sensor due to flow induced pressure gradients between pressure communication point 31 and the position of the pressure sensor.

A multiple barrier fluid configuration of FIG. 3 can also be achieved with an annular vessel similar to that shown in the separate plan view detail in FIG. 1. The choice of either configuration depends upon ease of fabrication and incorporation into a particular well.

Figure 4:
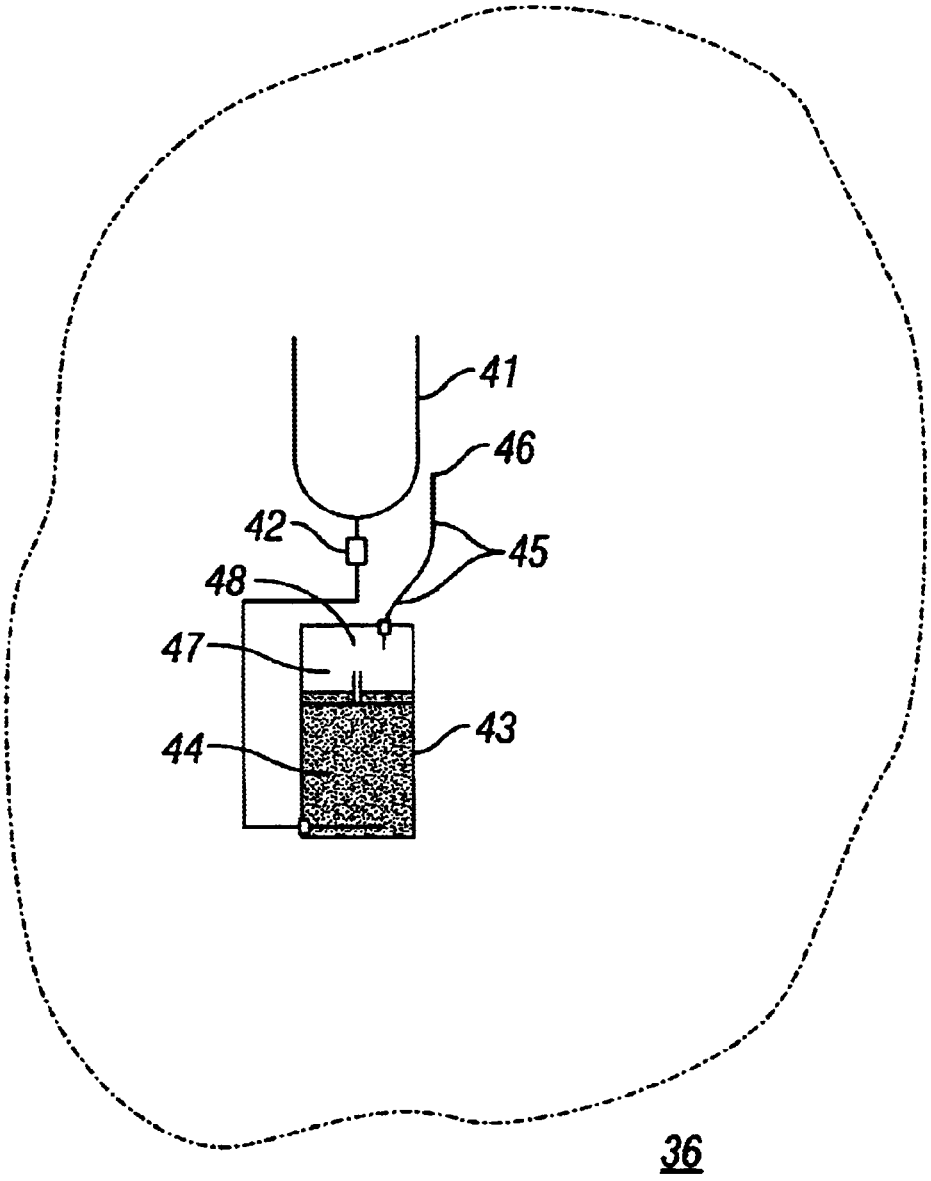
FIG. 4 depicts a schematic diagram of a second barrier fluid assembly which can be used in the sensing apparatus of the present invention.

In FIG. 4 we show the control line highway 41containing one or more sensors connected into a barrier fluid reservoir 43 via a section of control line that can include a flow control device 42. The hydrocarbon reservoir fluid 45 is allowed direct access to the interior of the barrier fluid reservoir at point 46 and can enter the chamber 43. In the barrier fluid container 43 is shown fluid 44 that acts as a fluid barrier between well bore fluid 45 and the sensor and its package. It is to be realised that a further fluid can be in the highway in the region where the sensor is located or above it. A mechanical piston 47 is shown separating the fluids 44 and 45. This piston can contain a small-bore connection 48 which can be filled with fluid 44. The piston assembly communicates the pressure of the well bore to the interior of the highway. When conditions are such that a large movement of liquid is required to move into or out of the highway, then the piston position will be adjusted in response to the existing pressure difference. Small errors can be introduced by stiction in the piston, but these will constitute a small part of the total change. When very small changes in pressure occur then it is preferable to have a direct fluid to fluid contact since stiction in the mechanical piston can hide such small change or introduce errors which are large in relation to the change which is to be measured. Such small pressure changes commonly occur in well tests after the initial large transient. These signals contain important information about the hydrocarbon reservoir and are of great interest to reservoir engineers. The fluid-to-fluid contact will circumvent this shortcoming and therefore allow very small pressure changes in the well bore to be measured accurately by the sensor in the highway. On the other hand the small bore fluid connection 48, on its own, will not be able to respond to large pressure changes without causing significant errors to occur over a period required for the fluid transfer to take place.

The mechanical piston can be designed so that it can be replaced by wireline or slickline intervention or by use of a robotic vehicle.

It will also be clear to those skilled in the art that alternative configurations can be devised which achieve the objectives of the apparatus shown in FIG. 3 in which mechanical means can be employed.

Figure 5:
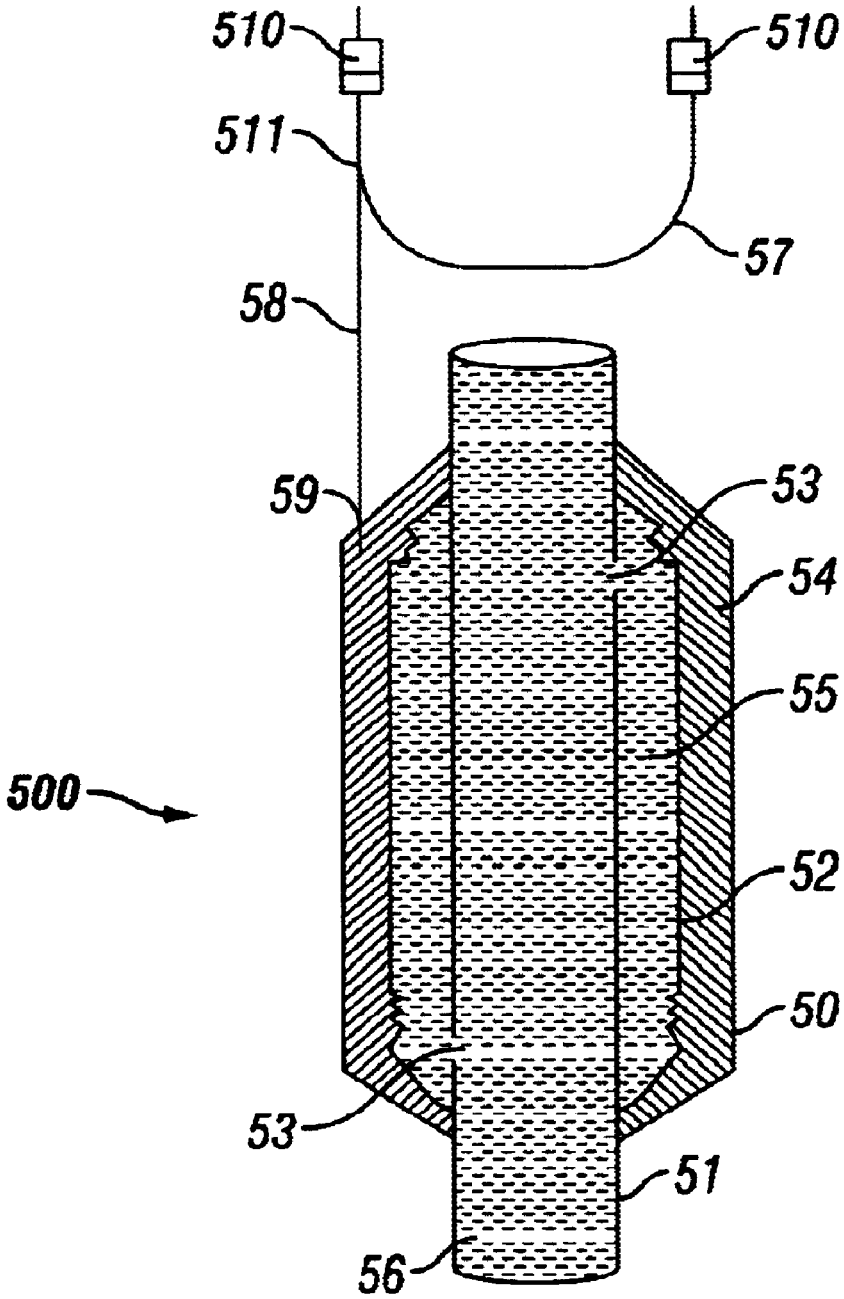
FIG. 5 depicts a schematic diagram of an apparatus that provides a mechanical isolation or separation of reservoir fluids from highway fluids.

FIG. 5 shows a non-limiting example of an apparatus that provides a mechanical isolation or separation of reservoir fluids from highway fluids. A membrane or diaphragm 52 is shown in an annular space 50 surrounding a production string 51. The membrane or diaphragm divides the annular space into two regions. On one side of the membrane is a space that contains a fluid 54. On the other side of the membrane is a space containing fluid 55. Fluid 55 is reservoir fluid also shown as 56. The reservoir fluid 56 can enter the adjacent annular space at one or more ports 53. The fluid 54 can be the same fluid as is used in the highway 57 that is connected to the outer annular space at port 59. If the pressure inside the production string changes then this change in pressure is communicated to the fluid inside the highway. The membrane adjusts its position in response to pressure changes. It is important to adjust the initial position of the membrane or diaphragm by applying pressure to the highway at the surface. The preferred static position of the membrane when the well is shut in and where the well bore pressure is therefore at its highest should be near the outer wall of the annular space. When the well is flowing at its maximum rate, the well bore pressure will generally be at it lowest. Going from well shut-in to well flowing can cause fluid transfer from the highway into the annular surge chamber. The size of the overall annular space is chosen to be sufficient for the particular well conditions. Where large changes in pressure are forecast, the length of the annular surge chamber has to be greater than in wells where relatively small changes are expected. When flow restrictors 510 are built into the highway above the position of the pressure sensor then the size of the chamber necessary is reduced. In general the preferred position of the pressure sensor inside the highway is near the connection to the annular surge chamber (shown as 511 in FIG. 5).

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. Apparatus for sensing one or more physical parameters at a remote location, comprising:

a first tubing containing a communication cable and a sensor in communication therewith, the sensor being located within the tubing proximate the remote location;

a second tubing having a first end in fluid communication with the first tubing proximate the sensor, and a second end;

a reservoir containing a barrier fluid, the reservoir having a first opening in fluid communication with the second end of the second tubing, and a second opening in fluid communication with the remote location; and a first flow control element disposed within the second tubing between the first tubing and the reservoir, the first flow control element configured to be actuated between a first state allowing fluid flow in the second tubing in any direction, and a second state restricting fluid flow in the second tubing from the reservoir to the first tubing.

2. The apparatus of claim 1 further comprising a second flow control element disposed within the first tubing, the second flow control element configured to be actuated between a first state allowing fluid flow in the first tubing in any direction, and a second state restricting fluid flow from the first tubing.

3. The apparatus of claim 1, wherein the first flow control element is adapted to be actuated by a signal.

4. Apparatus for sensing one or more physical parameters at a remote location, comprising:

a first tubing containing a communication cable and a sensor in communication therewith, the sensor being located within the tubing proximate the remote location;

a second tubing having a first end in fluid communication with the first tubing proximate the sensor, and a second end;

a reservoir containing a barrier fluid, the reservoir having a first opening in fluid communication with the second end of the second tubing, and a second opening in fluid communication with the remote location; and a gel plug disposed within the second tubing between the first tubing and the reservoir, the gel plug comprising a volume containing a gel selected to chemically isolate the barrier fluid from fluids within the first tubing.

5. The apparatus of claim 4 further comprising a third tubing having a first end in fluid communication with the reservoir, and a second end in fluid communication with the remote location, and further comprising a fluid actuated control valve disposed within the third tubing, the fluid actuated control valve being responsive to open when fluid is pumped through the first, second and third tubings.

6. Apparatus for sensing one or more physical parameters at a remote location, comprising:

a first tubing containing a communication cable and a sensor in communication therewith, the sensor being located within the tubing proximate the remote location;

a second tubing having a first end in fluid communication with the first tubing proximate the sensor, and a second end;

a reservoir containing a barrier fluid, the reservoir having a first opening in fluid communication with the second end of the second tubing, and a second opening in fluid communication with the remote location; and a fluid motive apparatus for passing fluid into the first and second tubings, and a fluid volume measuring device configured to measure the volume of fluid passed into the first and second tubings by the fluid motive apparatus.

7. Apparatus for sensing one or more physical parameters at remote locations, comprising:

a first tubing containing a communication cable and a plurality of sensors in communication therewith, each said sensor being located within the tubing proximate a respective remote location; and a plurality of fluid barrier sensing sections, each said fluid barrier sensing section comprising:

a second tubing having a first end in fluid communication with the first tubing proximate one of the sensors, and a second end; and a reservoir containing a barrier fluid, the reservoir having a first opening in fluid communication with the second end of the associated second tubing, and a second opening in fluid communication with the associated remote location.

8. A fluid barrier for isolating a sensor contained within a tubing from an environment at a location proximate the sensor, comprising:

a fluid conduit having a first end in fluid communication with the tubing proximate the sensor, and a second end;

a first reservoir having a first opening in fluid communication with the remote location, and a second opening in fluid communication with the second end of the fluid conduit, the first opening being distal from the second opening, the first reservoir containing a first fluid having a first specific gravity; and a second reservoir disposed within the fluid conduit between the first reservoir and the tubing, the second reservoir having first and second openings for connecting to the fluid conduit, the first opening of the second reservoir being distal from the second opening of the second reservoir, the second reservoir containing a second fluid having a second specific gravity different than the first specific gravity.

9. The fluid barrier of claim 8 wherein the second reservoir is located elevationally higher than the first reservoir, and further wherein the first specific gravity is greater than the second specific gravity.

10. The fluid barrier of claim 9 further comprising a fluid actuated control valve disposed within the fluid conduit between the second reservoir and the tubing, the fluid actuated control valve being responsive to open when fluid is pumped through the fluid conduit towards the second and first reservoirs.

11. The fluid barrier of claim 8 wherein the first and second fluids are essentially immiscible with one another, and further wherein the first fluid is selected to be essentially chemically inert with an environment at the remote location.

12. Method for chemically isolating a sensor from a location at which a parameter is to be measured by the sensor, the location being in a fluid environment, comprising:

emplacing within a tube a sensor in signal communication with a communication cable, the sensor being located within a section of the tube proximate the location at which the parameter is to be measured;

placing in fluid communication with the section of the tube containing the sensor a fluid reservoir, the fluid reservoir further being placed in fluid communication with the fluid environment;

isolating the tube to prevent passage of fluid out of the tube; and passing a first fluid into the tube to cause the fluid to flow into the fluid reservoir.

13. The method of claim 12 further comprising measuring the volume of the first fluid passed down the tube and into the fluid reservoir, and ceasing flowing the first fluid into the tube when a sufficient volume of the first fluid has been passed down the tube to fill at least a portion of the fluid reservoir.

14. The method of claim 13 further comprising placing in flow-through fluid communication with the section of the tube containing the sensor and the fluid reservoir a second fluid reservoir, and passing a second fluid into the tube to cause the second fluid to flow into the second fluid reservoir.

15. Apparatus for protecting at least a sensor and a fiber optic cable surrounded by fluids which are inert with respect to the sensor and fiber optic cable located in a sensor highway which includes a fluid reservoir containing one or more barrier fluids, which reservoir is connected on one side of the one or more barrier fluids to the sensor highway and on the other side of the one or more barrier fluids is connected to a hydrocarbon reservoir fluid, wherein the one or more barrier fluids in the fluid reservoir form a barrier against the ingress of molecules from the hydrocarbon reservoir fluid to the sensor highway side of the fluid reservoir where the sensor and fiber optic cable are located, wherein the sensor highway comprises a conduit through which the sensor and fiber optic cable are adapted to be moved from one location to another location.

16. The apparatus of claim 15, wherein the sensor and fiber optical cable are adapted to be moved through the sensor highway by fluid flow in the sensor highway.

17. The apparatus of claim 16, wherein the sensor highway comprises a conduit adapted to extend a length along a wellbore.

18. The apparatus of claim 15, wherein the sensor highway has a first section adapted to extend from a well surface to a remote location in a well, and a second section adapted to extend from the remote location back to the well surface.

19. Apparatus for sensing one or more physical parameters at a remote location, comprising:

a first tubing containing a communication cable and a sensor in communication therewith, the sensor being located within the tubing proximate the remote location;

a second tubing having a first end in fluid communication with the first tubing proximate the sensor, and a second end; and a reservoir containing a barrier fluid, the reservoir having a first opening in fluid communication with the second end of the second tubing, and a second opening in fluid communication with the remote location, wherein the cable and sensor are adapted to be moved from a first location to a second location through the first tubing.

20. The apparatus of claim 19, wherein the cable and sensor are adapted to be moved by fluid flow in the first tubing.

21. The apparatus of claim 19, further comprising a highway extending a length of a wellbore, the highway comprising the first tubing.

22. The apparatus of claim 19, wherein the cable and sensor are adapted to be moved from a well surface to the remote location in a well through the first tubing.

23. Apparatus for sensing one or more physical parameters at a remote location, comprising:

a first tubing containing a communication cable and a sensor in communication therewith, the sensor being located within the tubing proximate the remote location;

a second tubing having a first end in fluid communication with the first tubing proximate the sensor, and a second end; and a reservoir containing a barrier fluid, the reservoir having a first opening in fluid communication with the second end of the second tubing, and a second opening in fluid communication with the remote location, wherein the sensor comprises an optical fiber sensor.

24. The apparatus of claim 23, wherein the cable comprises an optical fiber cable.

25. Apparatus for sensing one or more physical parameters at a remote location in a well, comprising:

a conduit containing a communication cable and a sensor coupled to the cable, the cable and sensor adapted to be deployed through the conduit from a first location to a second location; and a barrier fluid assembly containing a first barrier fluid, the first barrier fluid adapted to isolate well fluids from fluid in the conduit.

26. The apparatus of claim 25, wherein the cable comprises an optical fiber cable.

27. The apparatus of claim 25, wherein the barrier fluid assembly contains a second barrier fluid that is non-miscible with the first barrier fluid.

28. The apparatus of claim 27, wherein the first and second barrier fluids have different densities.

29. The apparatus of claim 27, wherein the barrier fluid assembly comprises two reservoirs, one containing the first barrier fluid and one containing the second barrier fluid.

30. The apparatus of claim 25, wherein the first barrier fluid comprises liquid metal.

31. The apparatus of claim 25, wherein the barrier fluid assembly comprises a reservoir containing the first barrier fluid, the reservoir having an opening to receive well fluids, the barrier fluid assembly further comprising a piston in the reservoir to separate the well fluids and the first barrier fluid, the piston to communicate pressure of the well to the conduit.

32. The apparatus of claim 31, wherein the piston comprises a bore extending through the piston to enable fluid contact between the first barrier fluid and the well fluids.

33. The apparatus of claim 25, wherein the cable and sensor are adapted to be deployed through the conduit by fluid flow in the conduit.

34. A method of sensing one or more physical parameters at a remote location in a well, comprising:

deploying a cable and sensor through a conduit extending into the well, wherein deploying the cable and sensor comprises deploying the cable and sensor from a first location to a second location in the conduit;

providing a barrier fluid assembly containing a barrier fluid; and isolating well fluids from fluid in the conduit with the barrier fluid.

35. The method of claim 34, wherein deploying the cable and sensor comprises deploying the cable and sensor through the conduit using fluid flow in the conduit.

* * * * *